United States Patent [19]

Nicpon

[11] 3,991,905

[45] Nov. 16, 1976

[54] HINGED COVER FOR OUTDOOR LAMP CASE

[75] Inventor: John E. Nicpon, Chicago, Ill.

[73] Assignee: Appleton Electric Company, Chicago, Ill.

[22] Filed: Jan. 27, 1975

[21] Appl. No.: 544,319

[52] U.S. Cl. ..... 220/343; 240/11.2 E; 240/41.55

[51] Int. Cl.[2] ..... B65D 43/02

[58] Field of Search ..... 240/41.35, 41.55, 47, 240/25, 11.2; 220/343, 82

[56] References Cited

UNITED STATES PATENTS

| | | | |
|---|---|---|---|
| 3,167,258 | 1/1965 | Wilde | 240/41.55 X |
| 3,377,473 | 4/1968 | Breeding et al. | 240/47 X |
| 3,390,373 | 6/1968 | Ruston | 240/47 X |
| 3,560,728 | 2/1971 | Atkin | 240/47 X |
| 3,829,677 | 8/1974 | Deflano | 240/41.35 R |

FOREIGN PATENTS OR APPLICATIONS

| | | | |
|---|---|---|---|
| 470,399 | 6/1914 | France | 220/343 |

*Primary Examiner*—Joseph F. Peters, Jr.
*Attorney, Agent, or Firm*—Darbo, Robertson & Vandenburgh

[57] ABSTRACT

A metal housing of a light fixture has a cover hinged over the front access opening. Within the housing is a halogen lamp or light bulb. Surrounding the lamp and facing forwardly is a reflector of generally parabolic shape. Extending across the back of the reflector parallel to the lamp is a forwardly extending ridge. A glass is held in the cover by clips frictionally engaged in pockets spaced about the inside of the cover. The cover hinge is formed by parts on the cover and housing, which parts are of generally "U" configuration. The pivot pin extends through the U of these parts. The parts are so positioned with respect to each other and stops are provided so as to prevent the disengagement of the pins by movement through the open end of the U. Within the housing are heat sinks to protect the lamp sockets.

2 Claims, 10 Drawing Figures

Fig. 1
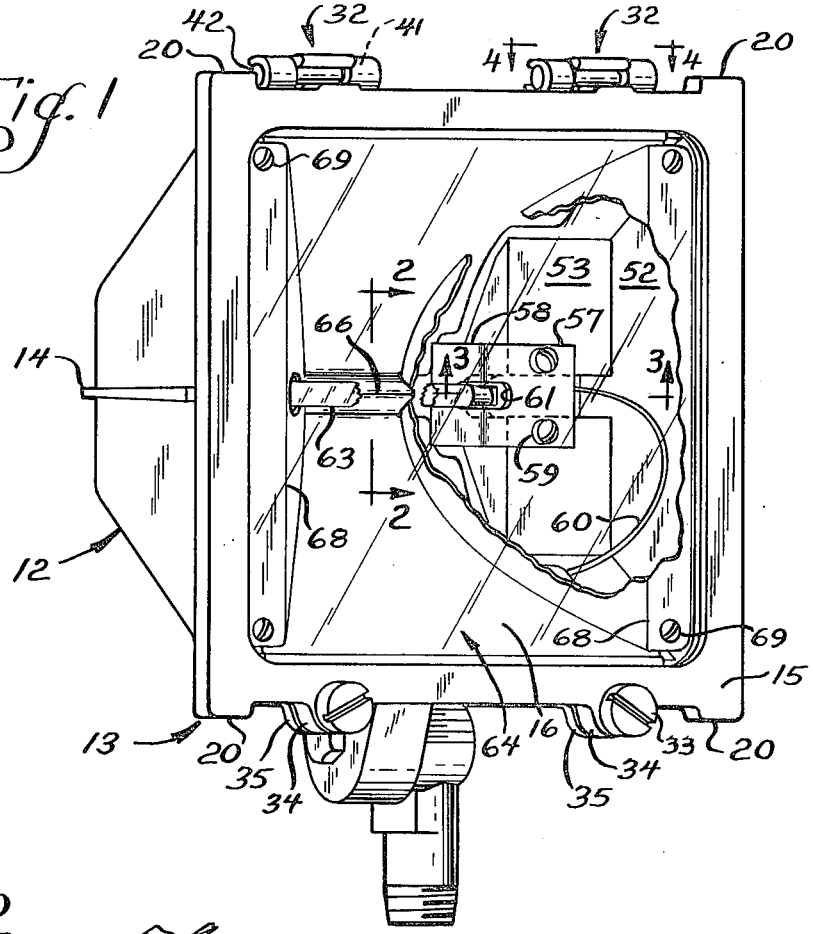
Fig. 2
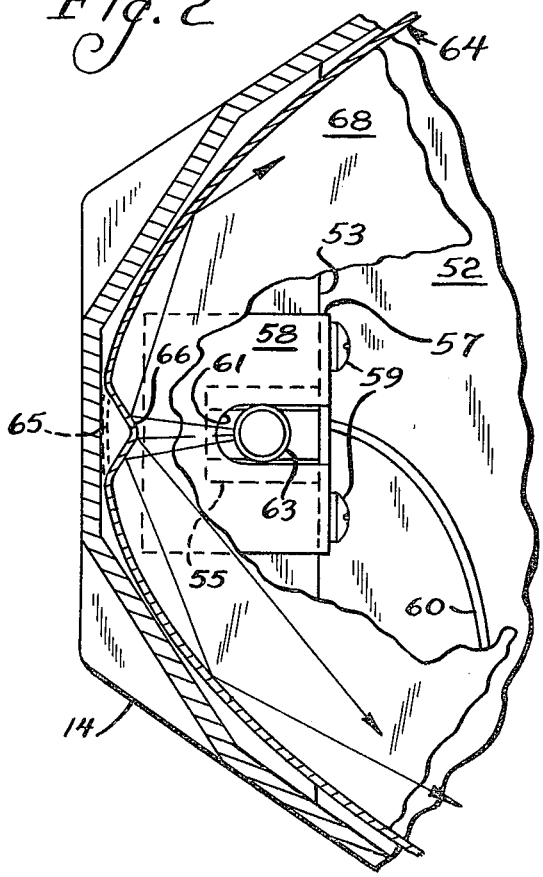
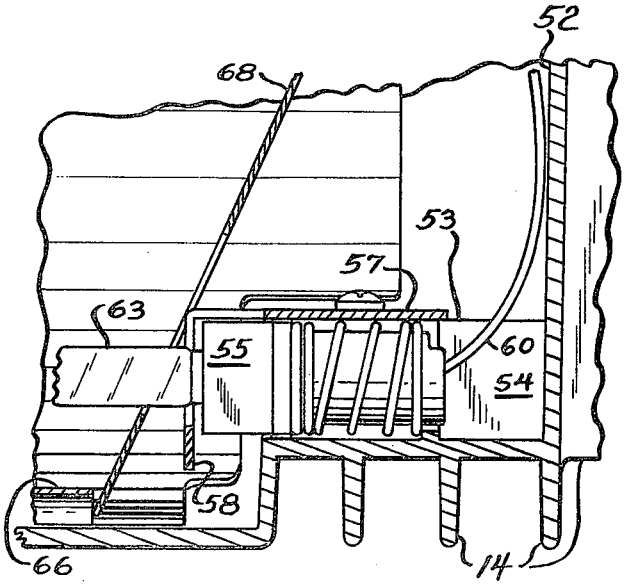
Fig. 3

HINGED COVER FOR OUTDOOR LAMP CASE

BACKGROUND AND SUMMARY OF THE DISCLOSURE

The present invention relates to an outdoor light fixture having features which will reduce the cost of manufacture while at the same time providing a quality unit which will have a satisfactory service life.

While the present invention, as will be apparent from the description of the specific embodiment, primarily relates to a weather tight outdoor lighting fixture of the type using a halogen lamp, it is not necessarily limited to this specific item. This type of lamp fixture is purchased by users (or on behalf of users) who expect to obtain a quality product, requiring substantially no maintenance, involving ease in the changing of bulbs, etc. It is not an inexpensive lamp fixture. At the same time, it is sold in a competitive market and it is important to the manufacturer that the manufacturing cost be at an absolute minimum. The principal object of the present invention is the attainment of these goals. Further objects and advantages will become apparent from the following description.

DESCRIPTION OF THE DRAWINGS

FIG. 1 is a front perspective view, partially broken away, of a light fixture embodying the present invention;

FIG. 2 is an enlarged partial section as viewed at line 2—2 of FIG. 1;

FIG. 3 is an enlarged partial section as seen at line 3—3 of FIG. 1;

DESCRIPTION OF SPECIFIC EMBODIMENT

Figure 5:
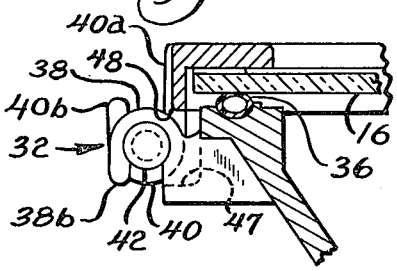
FIG. 5 is a partial section as seen at line 5—5 of FIG. 4.
Figure 4:
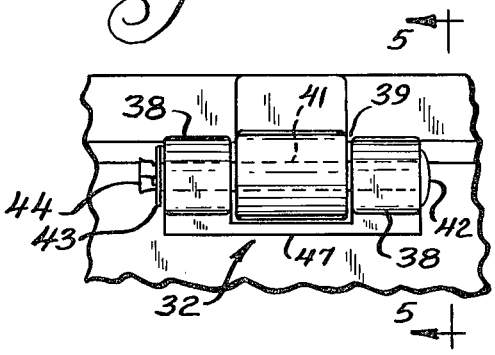
FIG. 4 is an enlarged partial plan view as seen at line 4—4 of FIG. 1.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The illustrated light fixture comprises a housing, generally 12, having a front opening which is closed by a cover, generally 13. For the purpose of dissipating heat, the housing has various forms of fins 14. The cover includes a frame 15 which is of generally rectangular configuration. The housing and frame of the cover are made of die cast metal. The cover has a central opening which is closed by a sheet of glass 16. The glass is larger than the opening in the frame and overlies the inside of the frame. At each of the four corners of the glass are resilient pads 17.

Figure 10:
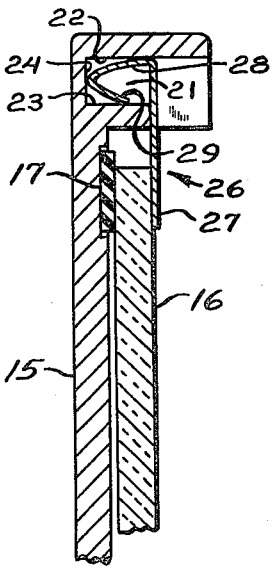
FIG. 10 is a partial section as viewed at line 10—10 of FIG. 9.
Figure 9:
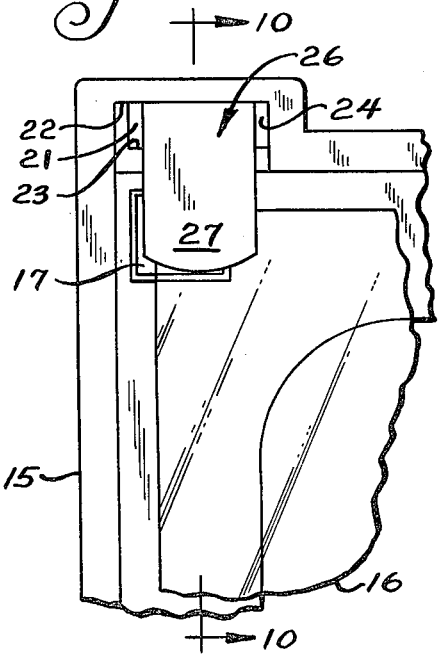
FIG. 9 is a rear view of the corner of the cover illustrated in FIG. 8.

At each of the four corners of frame 15 are enlargements 20. At the rear side of these enlargements are pockets 21 in part defined by spaced, parallel walls 22 and 23. Each pocket also has a base 24. A spring metal clip, generally 26, is used at each corner to hold the glass 16 against the frame 15 (or pad 17). Each clip has a portion 27 which overlies the glass and a second portion which extends into pocket 21. This second portion comprises a proximal part 28 and a distal part 29. These two parts are positioned generally in the form of a "V" with the point of the V being in juxtaposition to base 24 of the pocket. The proximal part 28 at its proximal end engages wall 22 of the pocket. The distal end of the distal part 29 engages wall 23 of the pocket. Since this distal end will have been cut from a sheet of spring metal when the clip was formed it has a relatively sharp edge. The shape of the V when the clip 26 is formed is somewhat larger than that illustrated in FIG. 10. Thus, when the clip is forced into the pocket the engagement of this sharp edge at the distal end of the clip with wall 23 is quite effective in resisting withdrawal of the clip from the pocket. The V configuration aids in making this engagement secure for all practical purposes. Furthermore, the V shape is a factor in making the clip relatively easy to insert into the pocket and thus facilitates assembly. The fact that the walls 22, 23 are parallel, or substantially so, does not complicate the die casting process for forming frame 15, as would some other arrangements for holding the glass to the back of the frame.

At the top, the frame is secured to housing 12 by means of a pair of hinges, generally 32. At the bottom are a pair of screws 33 which extend through bosses 34 of frame 15 and are threaded into bosses 35 of housing 12. A generally rectangular gasket 36 is seated in a groove in housing 12 surrounding the front opening of the housing. When the cover is closed this gasket bears against glass 16 and forms a weather tight seal between the cover 13 and the interior of the housing 12.

The hinges 12 comprise a first, generally U-shaped mounting device 38 which is a unitary part of the housing. It has a slot 39 in which is received a unitary, generally U-shaped mounting device 40 of the cover frame 15. A pin 41 extends between these mounting devices. The pin has a head 42 at one end thereof. The pin is slipped into place from one end after the mounting devices 38, 40 are brought into final alignment. To secure the pin in place, the other end then has a washer 43 placed thereon with the end then being deformed, as by means of a non-uniform crimping to produce the crimped end 44. The non-uniform crimping enlarges portions of the end so that the washer 43 no longer will slip off the end.

The U-shaped mounting device 38 has a proximal end **38*a* and a distal end 38*b* with a curved base therebetween. Similarly, the mounting device 40 has a proximal end 40*a*, a distal end 40*b* and a curved base therebetween. As perhaps best seen in FIG. 6, these ends extend substantially beyond the periphery of pin 41. They are arranged so that when the cover is closed (as, for example, seen in FIG. 5) the U-shaped device 40 has the open end of the U facing upwardly and the open end of the U-shaped device 38 is facing downwardly. The U-shaped device 38, below slot 39, includes a crossbar 47. At each side of the U-shaped device 40 the frame has edges 48 immediately adjacent the open end of the U. These edges along with the crossbar 47 and, in the fully closed position, the housing 12 and frame 15, form stop means to prevent separation of the hinges; that is, to prevent the pin 41** from moving out through the open end of either of the U-shaped devices.

Figure 6:
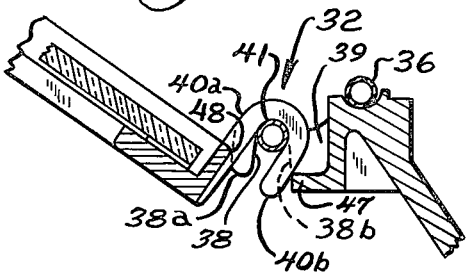
FIG. 6 is a view similar to FIG. 5, but illustrating the cover in the open position.
Figure 7:
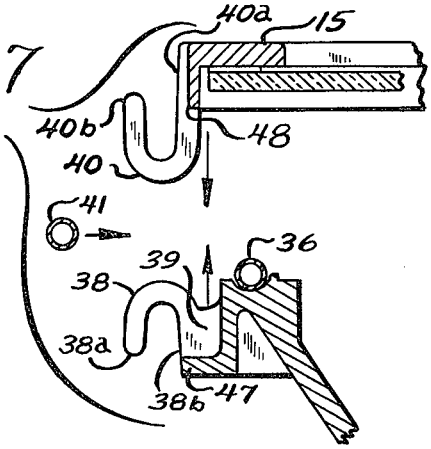
FIG. 7 is an exploded view of the hinge illustrated in FIG. 5.
Figure 8:
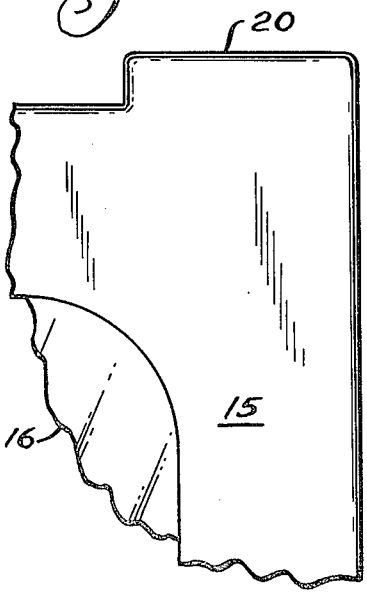
FIG. 8 is an enlarged front view of a corner of the cover.

When the cover is closed, as for example illustrated in FIG. 5, the pin is trapped between the two oppositely facing U's. Movement of the cover downwardly in FIG. 5 is prevented by the contact between the cover and the housing. The cover cannot move upwardly (in the orientation of FIG. 5) because this would necessitate an upward movement of device 40 and pin 41, which upward movement is prevented by the U-shaped device 38. As the cover is opened toward the FIG. 6 position the pin 41 remains trapped between the two U-shaped devices. An upward movement of the cover with respect to the housing is prevented by the trapped pin, as just described. A downward movement of the cover with respect to the housing is prevented because the U-shaped device 40 is trapped in slot 39 by reason of the presence of crossbar 47. The fully opened position of the cover is illustrated in FIG. 6. At this time either or both of the following occurs: (1) the distal ends 40*b* come into contact with crossbar 47; (2) the edge 48 of the frame 15 comes into contact with distal ends 38*a*. Ideally, these would occur simultaneously, but because the manufacturing tolerances are not extremely exact (and need not be), one may occur before the other.

Within the housing it has two sides 52 which are of stepped configuration with a platform 53 therebetween. At the platform portion of each side there is a cavity 54 to receive a lamp socket 55. Extending across the front of the socket 55 and the cavity 54 is one leg 57 of an L-shaped heat sink having a second leg 58. This heat sink is formed of aluminum and fastened to platform 53 by screws 59 threaded into the housing. The leg 58 extends across the end of the socket 55 to intercept the majority of the radiation transmitted in that direction. To the extent that the heat sink is thereby heated, that heat flows through leg 57 to the metal of the housing 12. The heat sink has an opening 61 in leg 58 thereof to permit the lamp 63 to be inserted into and removed from the socket. There is a corresponding heat sink over the socket at the opposite end of the lamp.

Extending between sockets 55 is an elongated tubular light bulb or lamp 63. In the illustrated embodiment this would be a quartz, iodine lamp. Around the lamp is a reflector, generally 64. In the main, this reflector is of generally parabolic configuration (as seen in cross-section, e.g., FIG. 2) with the axis of lamp 63 being at the focal point of the parabola. In the present instance, however, the parabola is modified so that at what normally would be the area of greatest curvature of the parabola, which area is indicated by dot-dash line 65, there is a V (or generally triangular) shaped ridge 66. The center of the V of this ridge is directly behind the lamp 63, is generally parallel to the axis of the lamp and approximately centered with respect to the parabola. The ridge extends for substantially the full length of the light emitting portion of lamp 63.

Without this ridge, the light emitted directly to the rear of the reflector 64 (i.e., the rays that normally would strike that portion of the parabola illustrated by dot-dash line 65) would be reflected from the reflector directly back at lamp 63. This causes undesired heating of the lamp and impairment of those rays from exiting through the glass 16. By the use of the ridge 66 the rays are deflected to one side or the other, as illustrated in FIG. 2, so that they will be emitted through glass 16 as useful light.

Adjacent each of the sides of the housing are aluminum walls 68. These walls are affixed to the housing by means of screws 69. As best seen in FIG. 3, they slant from the front of the housing towards each other at the rear of the housing. The shiny aluminum of walls 68 also serves a reflective function. These walls have openings through which the lamp 63 extends. One of these openings is extended in the front to back direction to facilitate the insertion and removal of lamp 63 (as best seen in FIG. 3). Walls 68 extend to the ends of ridge 66. The light striking walls 68 will not be reflected directly back at lamp 63.

I claim:

1. In electrical paraphernalia including a housing having a plurality of sides with an opening in one of said sides, a cover over said opening, hinge means connecting the housing and cover to permit the cover to be moved between various angles of orientation with respect to the housing, said hinge means comprising a first device affixed to the housing, a second device affixed to the cover and a pin of a given diameter connecting the two devices, one of said devices defining a slot intermediate thereof within which slot the other device is positioned, the improvement comprising:

each device being generally U-shaped with a distal end, a proximal end and a curved base connecting said ends, the proximal ends of the first device being affixed to the housing and the proximal end of the second device being affixed to the cover, as viewed in cross-section said ends extending substantially farther than the periphery of said pin, said devices being positioned so that when said cover is closed on said housing the U's face in opposite directions whereby the pin is clamped between the bases of the two devices; and said housing and cover including stop means to prevent the devices from moving sufficiently far away from the pin so that the pin can exit from the opening of the U, said stop means being effective at all angles of orientation of the cover with respect to the housing.

2. In electrical paraphernalia as set forth in claim 1, and in which the cover abuts said one side of the housing when the cover is closed, the improvement comprising:

said second device extending rearwardly from said cover and along the adjacent side of the housing, and being positioned so that when the cover is closed the open end of the U of the second device faces forwardly, said distal ends of the first device extending rearwardly sufficiently to be in the path of the cover when the cover is opened to block further movement of the cover in the opening direction, in said closed position of the cover said stop means comprises said cover abutting said housing as aforesaid, said stop means also including a portion of said cover in immediate juxtaposition, as viewed in cross-section normal to said pin, to said first device throughout the path of movement of the cover and a portion of the housing in immediate juxtaposition, as viewed in cross-section normal to said pin, to the second device throughout the path of movement of the cover.

* * * * *